United States Patent [19]

Scott

[11] 4,435,993

[45] Mar. 13, 1984

[54] CONTROL KNOB TO SHAFT ASSEMBLY

[75] Inventor: Allen W. Scott, Louisville, Ky.

[73] Assignee: General Electric Company, Louisville, Ky.

[21] Appl. No.: 362,587

[22] Filed: Mar. 29, 1982

[51] Int. Cl.[3] ..... G05G 1/10

[52] U.S. Cl. ..... 74/553; 464/116; 16/118; 16/DIG. 30; 16/121; 116/304

[58] Field of Search ..... 74/553, 558; 464/116; 16/121, 118, DIG. 30, DIG. 41, 24, 25; 116/304; 292/336.5, 353, 358

[56] References Cited

U.S. PATENT DOCUMENTS

| | | | |
|---|---|---|---|
| 765,909 | 7/1904 | Voight | 292/358 X |
| 1,970,758 | 8/1934 | Lyons et al. | 292/358 |
| 2,075,829 | 4/1937 | Ottinger | 292/358 X |
| 2,964,928 | 12/1960 | Marquis | 464/116 |
| 3,177,685 | 4/1965 | Piatti | 464/116 |
| 3,390,903 | 7/1968 | Sabonis | 16/121 X |
| 3,406,534 | 10/1968 | Chapper | 464/115 |
| 3,609,994 | 10/1971 | Colletti et al. | 464/9 |
| 3,719,378 | 3/1973 | Windsor | 403/289 |
| 3,922,883 | 12/1975 | Bevacqua | 464/120 |
| 4,011,513 | 3/1977 | Kawachi | 455/157 |
| 4,141,226 | 2/1979 | Sasahara | 464/117 |
| 4,147,445 | 4/1979 | Claesson | 74/553 X |

*Primary Examiner*—Leslie A. Braun
*Assistant Examiner*—Frank H. McKenzie, Jr.
*Attorney, Agent, or Firm*—Frederick P. Weidner; Radford M. Reams

[57] ABSTRACT

A control knob to shaft assembly including a rotatable, bifurcated shaft, the bifurcation spanning the diameter of the shaft and having a central cylindrical bore interconnecting two open slots, one of which has a width larger than the other. There is also provided an escutcheon plate in a plane that intersects the longitudinal axis of the shaft at an acute angle and has an opening therethrough. A knob is received in the escutcheon plate opening and has a first portion larger in diameter than the escutcheon plate opening, a second portion having two projecting spaced parallel legs with a yoke connecting and spanning the legs. The yoke has a central ball shaped portion with a diameter slightly smaller than the cylindrical bore in the shaft and is received in the cylindrical bore. The yoke also has two cross elements between the ball shaped portion and each of the legs, one cross element having a diameter slightly smaller than the diameter of the width of one of the open slots in the shaft and receivable therein and the other cross element has a diameter slightly smaller than the width of the other open slot in the shaft and is also received therein. The knob has a third portion interconnecting the first and second portions with the third portion having means to rotatably secure the knob to the escutcheon plate.

5 Claims, 6 Drawing Figures

CONTROL KNOB TO SHAFT ASSEMBLY

BACKGROUND OF THE INVENTION

The present invention relates to a control knob to shaft assembly and more particularly is directed to such an assembly wherein the knob has its rotational central axis at an angle to the longitudinal axis of the shaft to which it is attached.

There are a large number of constructions for securing control knobs to shafts. In simple rotatable controls, spline arrangements have been used where the rotational central axis of the knob and the central longitudinal axis of the shaft coincide. There are occasions, however, wherein it is desirable that the rotational central axis of the knob be at an angle relative to the central axis of the shaft yet have the rotational movement of the knob transmitted to the shaft without any lost motion between the two. For exaple, in the case of an appliance such as a dishwasher that has a timer with a setting shaft on the horizontal it can be beneficial to have the escutcheon plate of the control panel in a plane at an angle to the vertical. With this arrangement the user, which in most cases would be standing, may set the timer by rotating the knob yet more easily observe the setting indications on the escutcheon plate surrounding the knob which may be at the user's waistline because the escutcheon plate is tilted at an angle toward the user's eyes.

By this invention, there is provided a control knob to shaft assembly that allows the rotational axis of the knob to be tilted at an angle relative to the longitudinal axis of the shaft yet allows the user to easily rotate the knob and have transmitted to the shaft accurate and precise rotational movement.

SUMMARY OF THE INVENTION

According to one aspect of this invention, there is provided a control knob to shaft assembly which includes a rotatable, bifurcated shaft, the bifurcation spanning the diameter of the shaft and having a central cylindrical bore interconnecting two open slots, one of which has a width larger than the other. There is an escutcheon plate, such as used on a dishwashing appliance, located in a plane that intersects the longitudinal axis of the shaft at an acute angle, said escutcheon plate having an opening therethrugh. There is a knob received in the escutcheon plate opening and has a first portion larger in diameter than the escutcheon plate opening, a second portion having two projecting spaced parallel legs with a yoke connecting and spanning the legs, said yoke having a central ball shaped portion with a diameter slightly smaller than the cylindrical bore in the shaft and received in the cylindrical bore. The yoke also has two cross elements between the ball shaped portion and each of said legs, one cross element having a diameter slightly smaller than the width of one of said open slots in the shaft and receivable therein and the other cross element having a diameter slightly smaller than the width of the other open slot in the shaft and received therin. The knob has a third portion interconnecting the first and second portions and said third portion has means to rotatably secure the knob to the escutcheon plate.

DESCRIPTION OF THE PREFERRED EMBODIMENT

Figure 1:
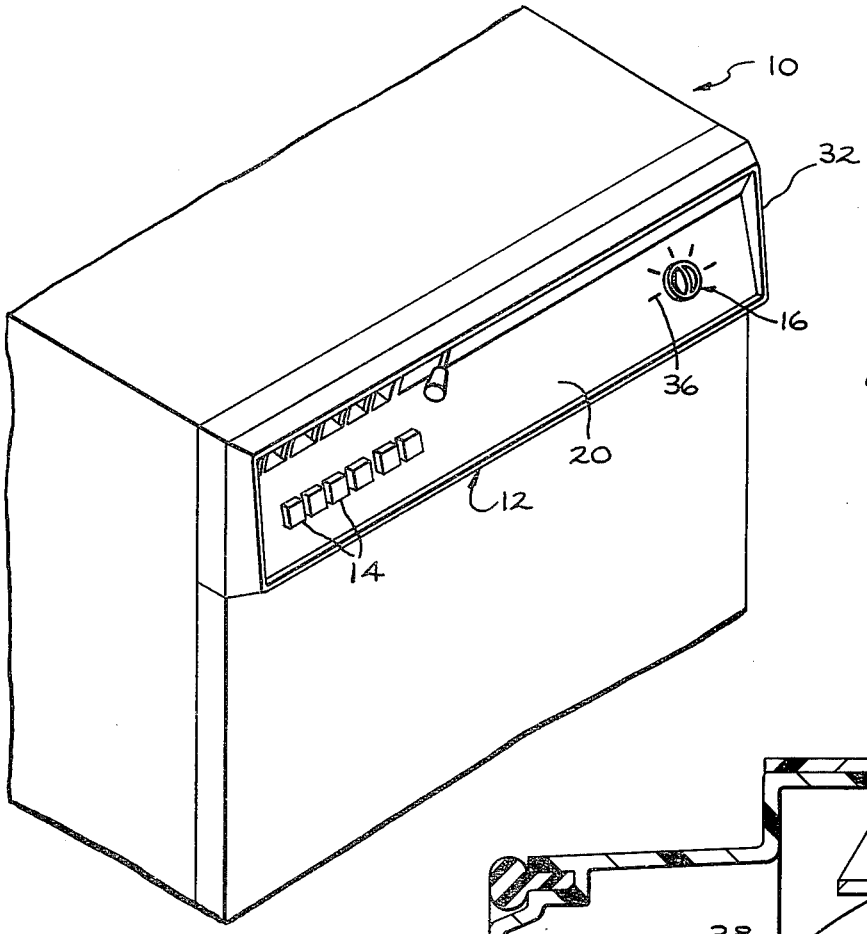
FIG. 1 is a perspective view of a portion of a dishwashing appliance showing one form of the present invention located on the control panel at the front of the dishwashing appliance.

FIG. 1 shows an appliance such as a dishwasher 10 having a control panel 12 at the front thereof to provide the user with selecting the mode of operation of the appliance such as by pushbutton switches 14. In conjunction with the mode of operation of the appliance it is often necessary that the period of time of operation be selected by the user and this is afforded by means of a timer mechanism located behind the control panel 12 which is manually settable by the user rotating a knob 16 coupled to a setting shaft of the timer. It is this type control knob to shaft assembly to which this invention relates. The control panel 12 has an escutcheon plate 20 which is desirably tilted from the vertical so that the user when standing may easily observe the indicia on the escutcheon plate that shows the various time periods and makes the proper settings accordingly.

Figure 2:
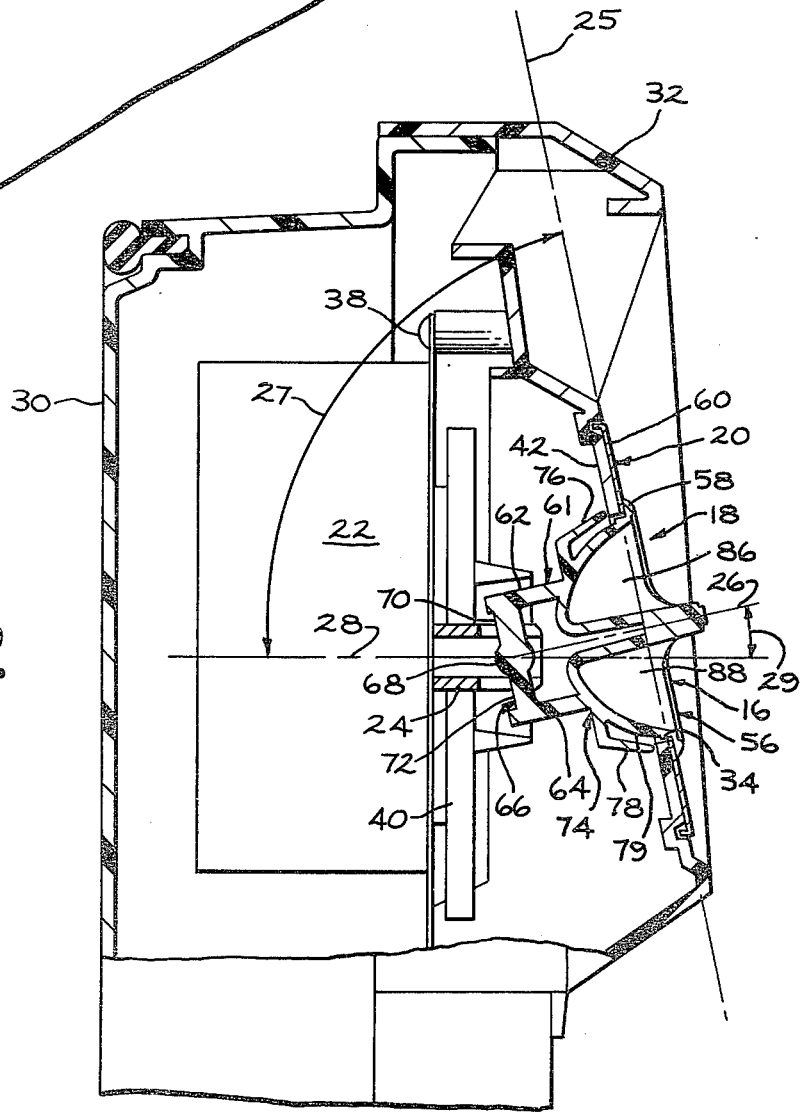
FIG. 2 is a cross-sectional view of the control panel of the dishwashing appliance incorporating one form of the present invention.
Figure 3:
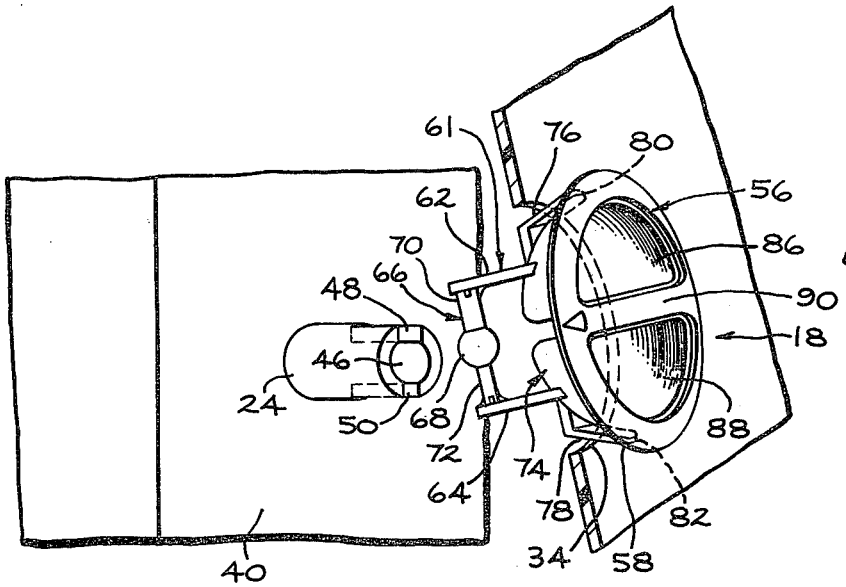
FIG. 3 is an exploded view of one form of the present invention.
Figure 6:
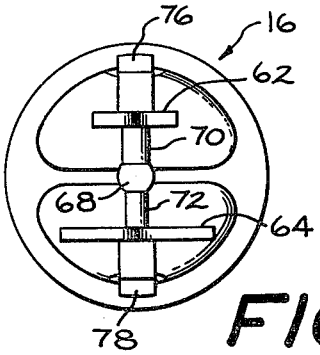
FIG. 6 is a view of the knob portion of one form of the present invention taken along lines 6—6 of FIG. 5.
Figure 5:
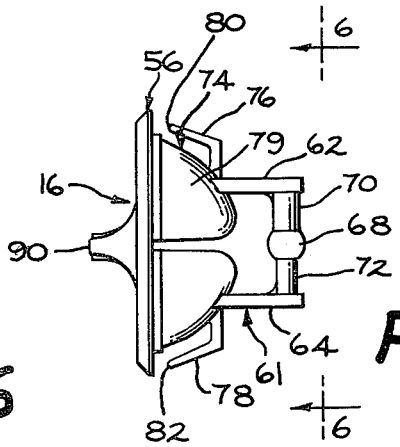
FIG. 5 is a side elevational view of the knob portion of one form of the present invention.

With reference to FIG. 2, the control knob to shaft assembly 18 of this invention is particularly useful because the timer 22 and its setting shaft 24 are desirably mounted within the appliance 10 such that the longitudinal or rotational axis 28 of the shaft 24 is horizontal. Since the escutcheon plate 20 is located in a plane designated 25 that intersects the longitudinal axis 28 of the shaft 24 at an acute angle designated 27, the knob 18 being mounted flush with the escutcheon plate will have its rotational axis 26 at an angle 29 relative to the rotational axis 28 of the shaft 24. The control panel 12 has a rear housing 30 covered by a front facing 32 which includes a portion thereof the escutcheon plate 20. The escutcheon plate 20 has a circular opening 34 therethrough to receive the knob 16. Surrounding the opening 34 is indicia 36 which may be utilized to indicate the time period for setting the timer 22 by rotation of the knob 16.

Figure 4:
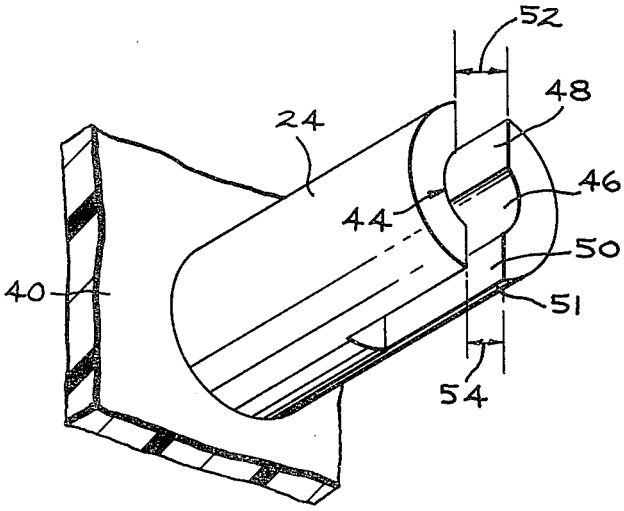
FIG. 4 is a perspective view of the shaft portion of one form of the present invention.

Located behind the escutcheon plate 20 and mounted in any suitable fashion to the front face 32 as by screws 38 is the timer 22 with the shaft 24 projecting through a portion of a mounting plate 40 and extending toward the rear surface 42 of the escutcheon plate 20. FIG. 4 shows in detail the form of the shaft 24. The cylindrical rotatable shaft 24 is bifurcated and the bifurcation 44 spans the diameter of the shaft 24. The bifurcation 44 has a central cylindrical bore 46 that extends longitudinally along the shaft and two open slots 48 and 50 interconnect the bore 46 with the cylindrical surface 51 of the shaft. One of the slots 48 has a width designated 52 greater than the width designated 54 of the other slot 50.

The knob 16 of the control knob to shaft assembly 18 consists of three portions. The first portion 56 is circular and larger in diameter than the escutcheon plate opening 34 so that when the knob is inserted into the opening 34 it will not pass completely through the opening but is retained in the opening with the first portion 56 having its peripheral edge 58 in rotational contact with the front surface 60 of the escutcheon plate 20. The second portion 61 of the knob 16 has two projecting spaced parallel legs 62 and 64 with a yoke 66 connecting and spanning the legs 62 and 64. The yoke 66 includes a central ball shaped portion 68 with a diameter slightly smaller than the inside diameter of the cylindrical bore 46 in the shaft 24 and is received in the cylindrical bore 46 as shown particularly in FIG. 2. The yoke 66 also includes two cross elements 70 and 72 between the ball shaped portion 68 and each of the legs 62 and 64. One cross element 70 has a diameter slightly smaller than the width of one of the open slots in the shaft and is receivable therein and the other cross element has a diameter slightly smaller than the width of the other open slot in the shaft and is received therein. In the preferred embodiment and as shown in the drawing, cross element 70 is received in the slot 48 which has the larger width 52 of the two slots and cross member 72 is received in the other slot 50 having a width 54. It will be understood that by having the diameters of the cross members 70 and 72 different but relative to the respective slots 48 and 50 into which they are to be received that the coupling of the second portion of the knob to the shaft can only be when the knob 16 and shaft 24 are correctly oriented.

The knob 16 has a third portion 74 interconnecting the first and second portions 56 and 61 and has means to rotatably secure the kob 16 to the escutcheon plate 20. It will be understood that the first, second and third portions that make up the knob 16 are all integrally molded and may be formed from suitable plastic material. The third portion 74 is bowl-shaped and has molded therewith a pair of opposing resilient fingers 76 and 78 on the outside surface 79 of the third portion 74 which have their terminal ends 80 and 82 respectively spaced outwardly of the surface 79 of the third portion 74 and also spaced from the first portion 56 of the knob. The spacing between the terminal ends of the fingers 80 and 82 from the first portion 56 is slightly greater than the thickness of the escutcheon plate 20. By this arrangement then the knob 16 is rotatably secured to the escutcheon plate 20 by inserting the second portion 61 and third portion 74 of the knob through the opening 34 with the resilient fingers 76 and 78 flexing inwardly to allow passage through the escutcheon opening and when passed through the opening the fingers flex outwardly to prevent withdrawal of the knob 16 from the opening 34. Also by this arrangement the knob may be rotated easily with the rotational axis of the knob being maintained by the relationship of the third portion 74 of the knob relative to the diameter of the opening 34 in the escutcheon plate. It will be understood that by the proper dimensioning and location of the shaft 24 and the dimensions of the knob 16 that when the knob is secured to the escutcheon plate 20 as described above, the second portion 61 of the knob will snap into the shaft 24.

To allow the user to readily manipulate and rotate the knob 16, the first and third portions 56 and 74 of the knob have two recess openings 86 and 88 separated by a cross member 90 which recess openings are accessible to the user through the front of the first portion 56. With the cross member 90 the user has good finger purchase of the knob 16 and thus can easily rotate the knob and in doing so rotate the shaft 24 in unison to set the timer to the period of time desired for the operation of the appliance.

With the above described control knob to shaft assembly there is accomplished a means for rotating a shaft with a knob having a rotational axis at an angle to the rotational axis of the shaft and there is no lost motion. Moreover, the assembly of the knob to the shaft with the correct relative orientation is accomplished and the assembly is quite simple to complete without the need for auxiliary fasteners, etc.

While, in accordance with the patent statutes, there has been described what at present is considered to be the preferred embodiment of the invention, it will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A control knob to shaft assembly comprising:

a rotatable, bifurcated shaft, the bifurcation spanning the diameter of the shaft and having a central cylindrical bore interconnecting two open slots, one of which has a width larger than the other, an escutcheon plate in a plane that intersects the longitudinal axis of the shaft at an acute angle, said escutcheon plate having an opening therethrough, a knob received in the escutcheon plate opening having, a first portion larger in diameter than the escutcheon plate opening;

a second portion having two projecting spaced parallel legs with a yoke connecting and spanning the legs, said yoke having a central ball-shaped portion with a diameter slightly smaller than the cylindrical bore in the shaft and received in said cylindrical bore, and two cross elements between the ball-shaped portion and each of said legs, one cross element having a diameter slightly smaller than the width of one of said open slots in the shaft and receivable therein and the other cross element having a diameter slightly smaller than the width of the other open slot in the shaft and received therein, and a third portion interconnecting the first and second portions, said third portion having means to rotatably secure the knob to the escutcheon plate.

2. The control knob to shaft assembly of claim 1 wherein the rotatable shaft is a horizontal shaft for a timer and rotation of the shaft sets the timer.

3. The control knob to shaft assembly of claim 1 wherein the means for rotatably securing the knob to the escutcheon plate is a pair of opposing resilient fingers attached to the third portion of the knob that flex inwardly to allow passage of the fingers through the escutcheon opening and then flex outwardly to engage the rear surface of the escutcheon plate.

4. The control knob assembly of claim 1 wherein the knob is integrally molded from plastic material.

5. The control knob assembly of claim 1 wherein the first and third portions of the knob have two recess openings separated by a cross member accessible to the user through the first portion to allow finger purchase of the cross member and easy rotation of the knob.

* * * * *